United States Patent [19]

Garchinsky

[11] 4,010,925

[45] Mar. 8, 1977

[54] ADJUSTABLE TRAFFIC SIGNAL MOUNTING ASSEMBLY

[75] Inventor: John S. Garchinsky, Aldan, Pa.

[73] Assignee: Gar Design Research, Inc., Media, Pa.

[22] Filed: Apr. 4, 1975

[21] Appl. No.: 565,120

[52] U.S. Cl. ..... 248/295; 248/316 A

[51] Int. Cl.[2] ..... A47F 5/00

[58] Field of Search ..... 248/316 R, 316 A, 316 C, 248/226 B, 115, 116, 295, 298, 114, 285, 286, 288, 289, 291, 296, 309; 24/263 R, 263 PT, 73 LA; 240/63, 73 BJ; 340/119; 29/511, 516, 517, 520, 525; 285/13, 14, 363, 330, 81, 92, 179, 355; 116/63, 115; 211/14

[56] References Cited

UNITED STATES PATENTS

| | | | |
|---|---|---|---|
| 615,250 | 12/1898 | Clark | 248/485 X |
| 952,608 | 3/1910 | Coppersmith | 285/181 X |
| 1,287,281 | 12/1918 | Fuller et al. | 340/119 UX |
| 1,291,388 | 1/1919 | Bright et al. | 29/516 |
| 1,833,462 | 11/1931 | Hagist | 285/330 X |
| 2,373,253 | 4/1945 | Martin | 285/179 X |
| 2,647,986 | 8/1953 | Kernodle | 248/296 X |
| 2,653,330 | 9/1953 | Nolan | 248/226 B X |
| 2,827,253 | 3/1958 | Nelson | 248/316 A X |
| 2,928,641 | 3/1960 | Pfaff | 248/289 X |
| 2,970,289 | 1/1961 | Loomis | 340/119 X |
| 3,181,103 | 4/1965 | Fedorick | 339/117 R X |
| 3,545,290 | 12/1970 | McCord et al. | 248/486 X |
| 3,586,280 | 6/1971 | Parduhn | 340/119 X |
| 3,642,311 | 2/1972 | Edgemond | 29/516 X |
| 3,746,348 | 7/1973 | Stone | 285/363 X |
| 3,764,099 | 10/1973 | Parduhn | 248/230 X |
| 3,792,603 | 2/1974 | Orain | 29/517 |

FOREIGN PATENTS OR APPLICATIONS

| | | | |
|---|---|---|---|
| 500,636 | 6/1930 | Germany | 248/116 |
| 596,136 | 12/1947 | United Kingdom | |

*Primary Examiner*—Lawrence J. Staab
*Attorney, Agent, or Firm*—Nelson E. Kimmelman

[57] ABSTRACT

A signal mounting assembly comprising first and second rigid, generally J-shaped tubular members each having a generally curved end portion attached to a generally straight portion. The cross-section of the second member is slightly larger than the cross-section of the first member so that the straight portion of the first member can be slid into the corresponding portion of the second member. The second member also has adjustable means for engaging and locking the first member when the two members are assembled together to the desired distance between their respective curved ends. In one form, the curved end portions include a straight terminal part in the form of a truncated cylinder which is joined to a correspondingly angled curved part. In another form, the curved portion includes a generally straight part which is terminated by an elbow attached to it.

11 Claims, 11 Drawing Figures

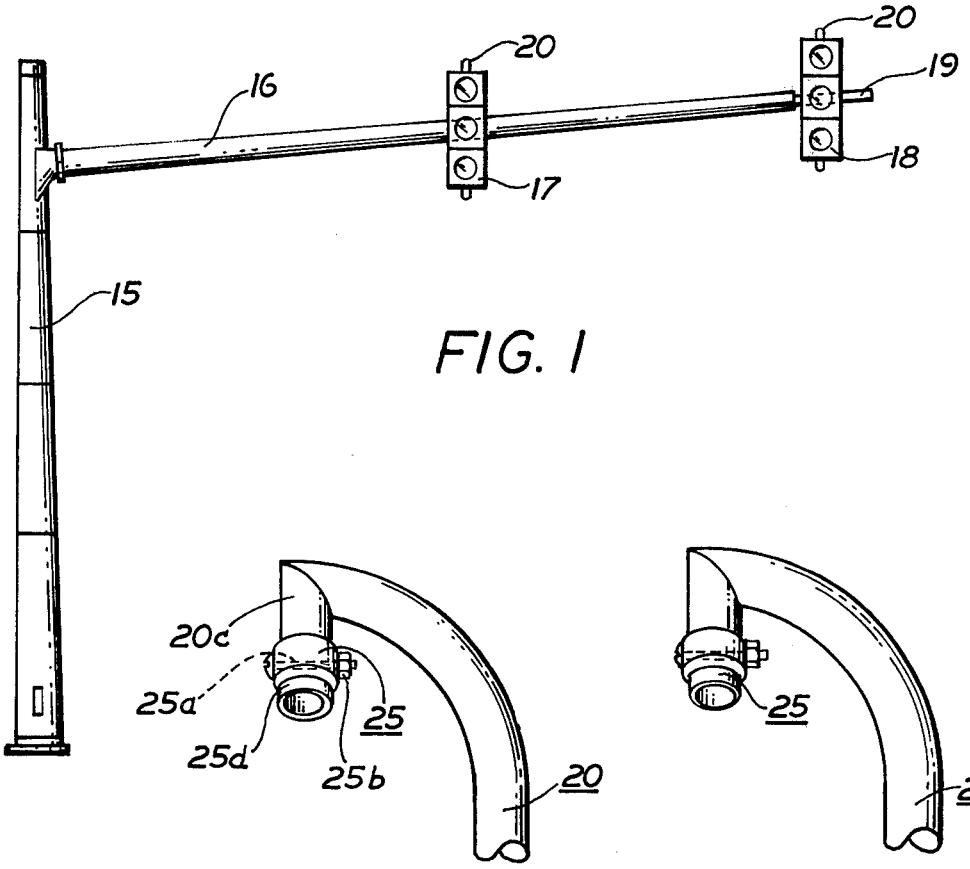
FIG. 1
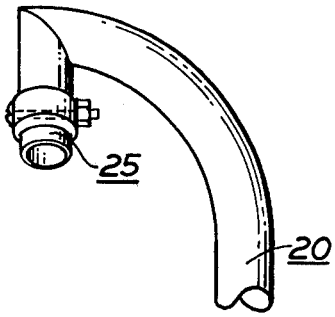
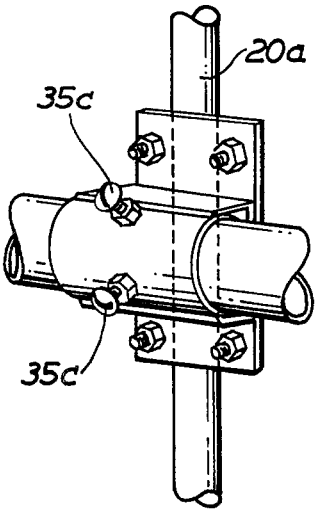
FIG. 4
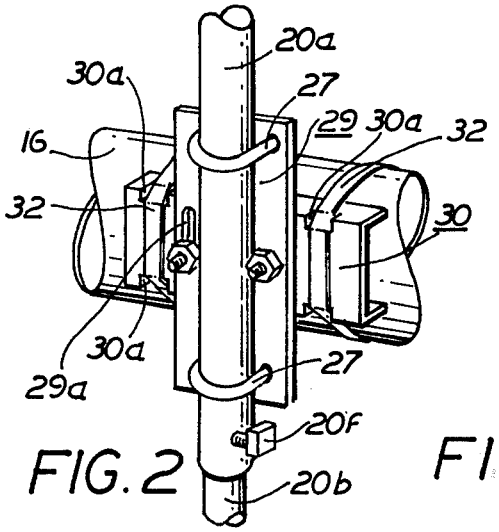
FIG. 2
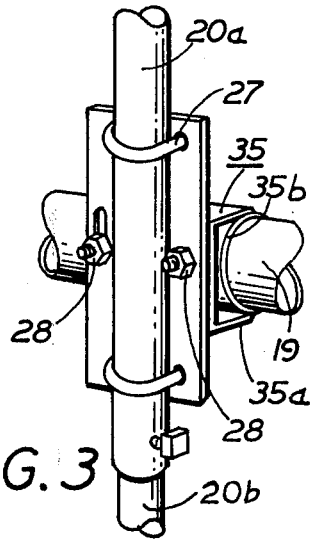
FIG. 3
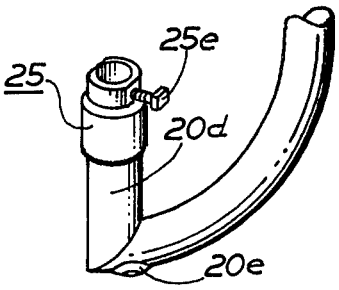
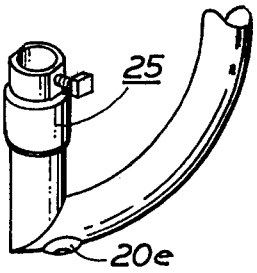

FIG. 8
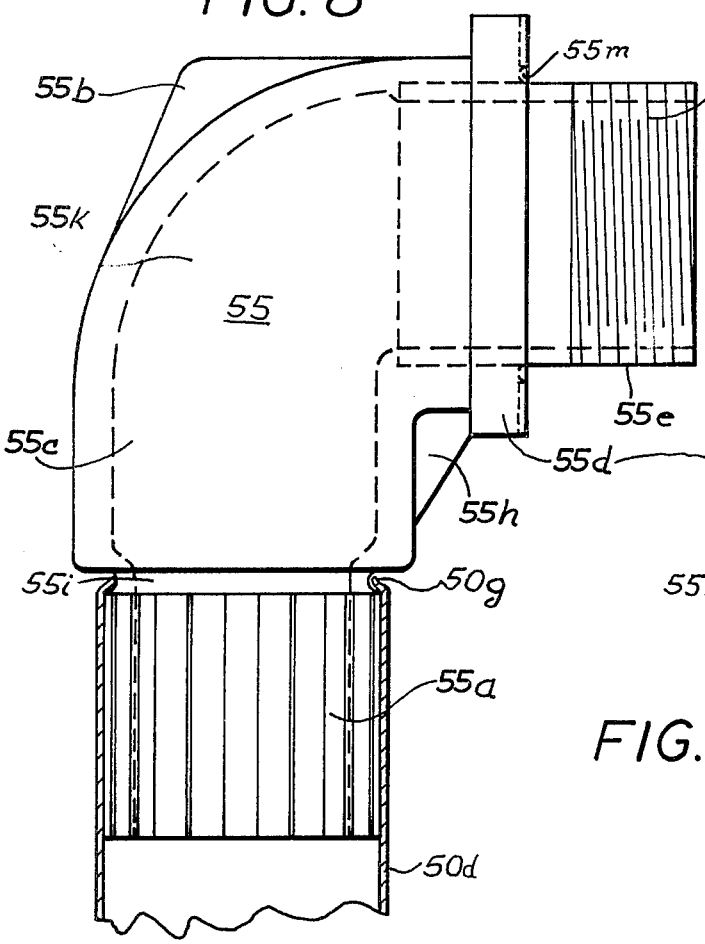
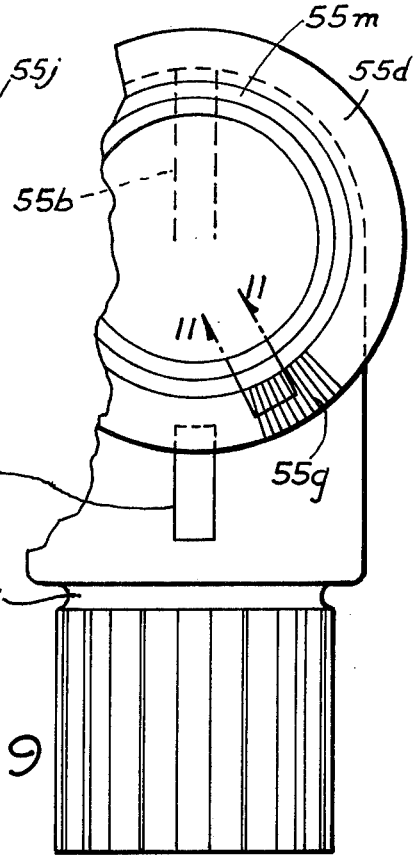
FIG. 9
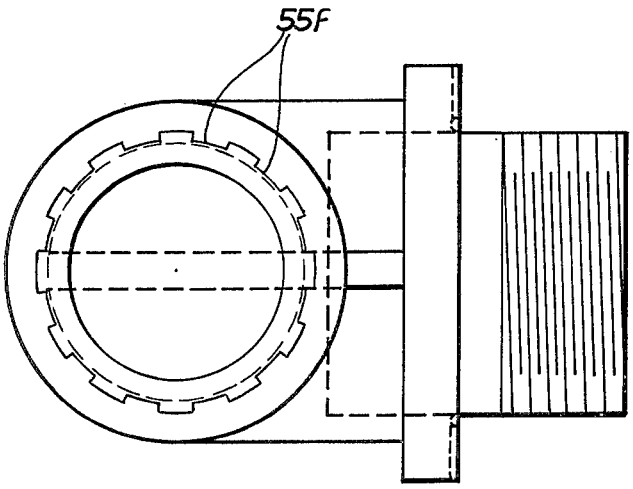
FIG. 10
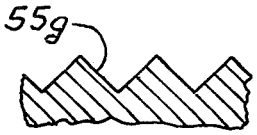
FIG. 11

ADJUSTABLE TRAFFIC SIGNAL MOUNTING ASSEMBLY

BACKGROUND OF THE INVENTION

1. Field of the Invention

The invention relates to a mounting bracket assembly for traffic signals and especially one which can accommodate various traffic signal assemblies of different dimensions.

2. Prior Art

Previous mounting assemblies for affixing traffic light assemblies to poles have included those made of two separate parts respectively connected to the top and bottom of the signal housing and separately fixed to the pole. Another form was generally C-shaped whose dimensions were fixed and non-adjustable so that it could be used only with traffic light assemblies of corresponding dimensions. There has been a need for a mounting assembly for traffic signals which could accommodate various sized traffic signals, which could be cheaply made and which could be installed with a minimum of labor. It is among the objects of the present invention to accomplish one or more of the foregoing objectives.

BRIEF SUMMARY OF THE INVENTION

A traffic signal mounting bracket comprises two generally J-shaped members having slightly differently-sized tubular straight portions so that the smaller straight section can be slid into the larger straight section a desired distance. Then adjustment of set screw in the larger section keeps the two members in a fixed relation while their other curved ends are connected to the light assembly housing.

BRIEF DESCRIPTION OF THE DRAWINGS

FIG. 1 is a side elevation view of two traffic light assemblies mounted on the arm of a traffic mast;

FIG. 2 is a detailed perspective view of the mounting assembly for the traffic light assembly shown mounted closest to the mast in FIG. 1;

FIG. 3 is a detailed perspective view of the mounting assembly for the traffic signal assembly shown disposed at the end of the arm in FIG. 1;

FIG. 4 is a fragmentary perspective view taken from the back of the apparatus shown in FIG. 3;

FIG. 8 is a side elevation view of the elbow shown in FIG. 7 as inserted into the mounting assembly;

FIG. 9 is a fragmentary and elevation view of the apparatus shown in FIG. 8;

FIG. 10 is a bottom view of the apparatus shown in FIG. 8; and

FIG. 11 is a fragmentary enlarged cross-sectional view of part of the apparatus shown in FIG. 9 taken along the section lines 11—11 in the direction indicated.

DETAILED DESCRIPTION OF THE PREFERRED EMBODIMENTS

Figure 6:
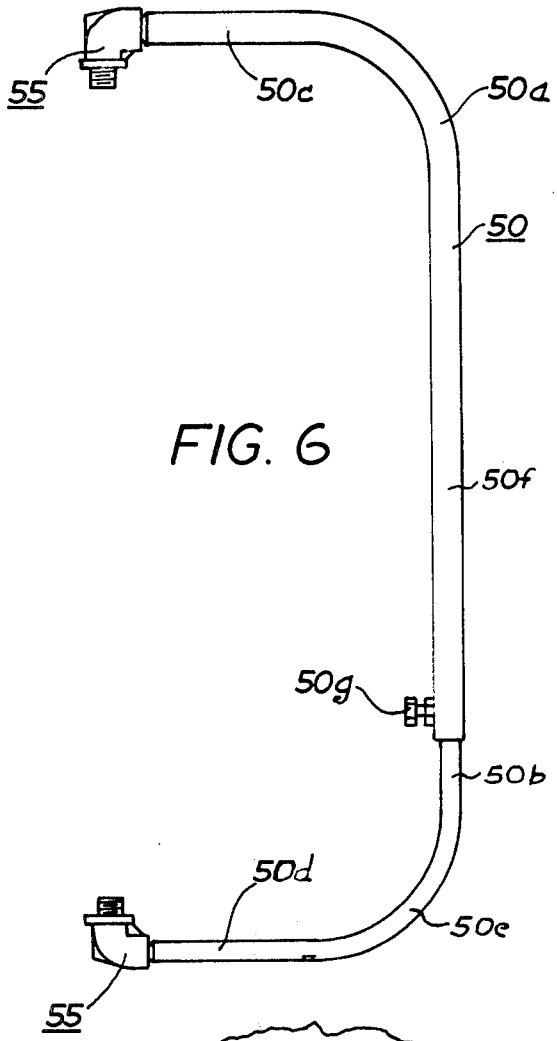
FIG. 6 is a side elevation view of still another form of the invention.

Referring to FIG. 1, there is shown a pole or mast 15 having a generally horizontal arm 16 on which a traffic signal 17 is mounted by means of bracket 20. A tenon 19 at the end of the arm 16 is the support for another bracket 20 on which the traffic signal assembly 18 is mounted.

As shown in FIG. 2, the mounting bracket assembly 20 comprises a first rigid, generally J-shaped tubular member **20*b* made of metal or other sufficiently strong material having a curved end portion 25*d* which is joined to a straight portion which fits into a correspondingly straight portion of a second rigid, generally J-shaped tubular member 20*a*. The second member has a curved portion 20*c* corresponding to the curved portion 20*d* of the first member. The curved portions 20*c* and 20*d* each comprise a cylindrical section joined by welding to an angled cut-off end of a curved section. A grommet hole equipped with a grommet 20*e* is provided near the weld to allow electrical wires to run through the truncated cylindrical section into the signal housing to energize the lights. The two members are maintained in a fixed relative position by means of a set screw 20*f* threaded in an aperture in member 20*a* which when screwed inwardly, contacts the straight portion of member 20*b***.

The bracket 20 is fixed to the arm 16 by means of two metal U-hooks 27 which pass through apertures in a metal plate 29 and which are secured at their other, threaded ends by means of nuts or equivalent (not shown). The plate 29 is itself connected to a channel member 30 having a generally C-shaped cross-section by bolts passing from the back through aligned apertures in the member 30 and in the plate 29, terminating in threaded foward ends which are secured by nuts as shown. One of the aligned apertures can be elongated to form an elongated slit **29*a* to permit some angular orientation of the plate 29 in its own plane to compensate for the angle of the mast 16 so that the assembly 17 can be truly vertical, or for some other angular deviation. The member 30 is itself connected to the mast 16 by stainless steel straps 32 that pass over the angled recessed portions 30*a* formed in the member 30. These angled recessed portions distribute the bearing area of the straps 32 on the member 30**. The straps may be secured in the conventional way by conventional steel strapping apparatus.

The assembly 17 itself is mounted on the bracket 20 by means of an upper collar 25 secured to the truncated cylindrical section by a bolt **25*a* passing through aligned apertures in the collar and in the portion 20*c*. The bolt is secured by nut 25*b* and the portion 25*d* engages the housing of the traffic signal assembly 17**.

At the lower end, the collar 25 is connected to the truncated cylindrical portion **20*b* and is provided with a set screw 25*e* in its upper, smaller diameter portion to engage the lower part of the traffic signal assembly 17**.

FIG. 3 shows how the traffic signal assembly 18 is mounted on the tenon 19, the bracket 20 being identical to the bracket used to mount assembly 17. The plate 29 can be connected by bolts, for example, to a C-channel member 30 that is itself welded at its edges to a tubular member **35*b* that is slightly larger than the cross-section of the tenon 19. The member 35*b* is slipped over the free end of the tenon 19 and is connected thereto by two angled set screws 35*c*** as shown in FIG. 4 which pass through threaded apertures in the member 35*b* and are retained in a fixed position by associated nuts as shown.

Figure 5:
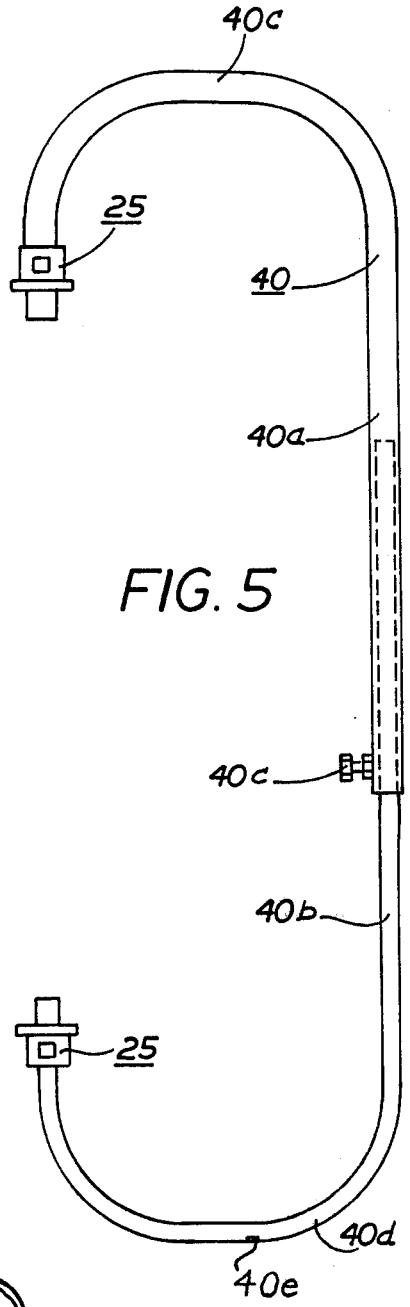
FIG. 5 is a side elevation view of another form of the mounting assembly according to the present invention.
Figure 7:
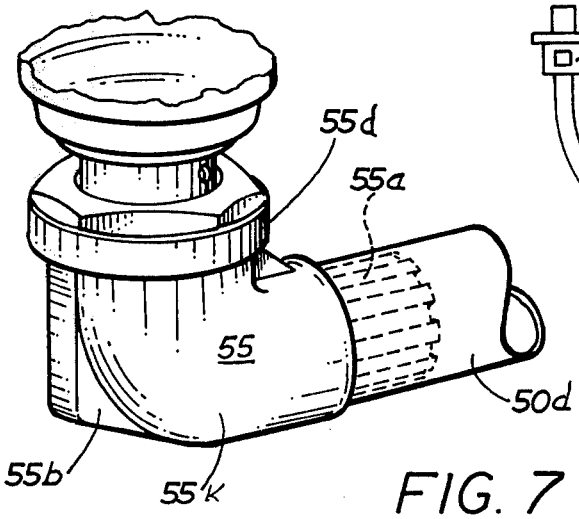
FIG. 7 is an enlarged perspective view of the elbow shown in FIG. 7 as inserted into the mounting assembly.

While the brackets 20 shown in FIGS. 1–3, being adjustable in height can accommodate quite a range of traffic signal assemblies having different heights, their construction can be simplified and, hence, their cost can be somewhat reduced by adopting the form shown in FIG. 5. Instead of having each tubular J-shaped member include a straight portion joined to a curved portion that has a generally truncated cylindrical terminal section welded to a curved section as shown in FIGS. 2 and 3, the bracket 40 of FIG. 5 comprises two generally J-shaped tubular members each of which is made of essentially a single piece of tubing. The first member comprises a smaller diameter straight portion 40*b* and a curved portion 40*d*. The smaller diameter straight portion 40*b* fits into the slightly larger tubular straight portion 40*a* of the second member which also has a curved portion 40*c*. A set screw 40*c* passes transversely through a threaded aperture in the wall of the straight portion 40*a* to engage the outside wall of the straight portion 40*b* and keep it in a fixed relation at the distance desired between the two terminal collars 25 affixed to the ends of the respective J-shaped members in the same way as shown in FIGS. 2 and 3. A minute hole 40*e* allows water vapor to escape.

FIGS. 6-11 show still another, even simpler form of the invention. Here the bracket 50, instead of having its constituent J-shaped members formed of single pieces of curved tubing with collars 25 attached to their ends, is formed by two generally L-shaped members, each terminated by an elbow-shaped member 55. Th first L-shaped member has a straight portion 50*b* joined by a curved portion 50*e* to a shorter straight portion 50*d*. The longer straight portion 50*b*, has a smaller cross-section than the cross-section of the corresponding portion 50*f* of the second L-shaped member. The second tubular member also has a curved portion 50*e* intermediate a straight portion 50*f* and a shorter straight portion 50*c*. Thus, the portion 50*b* can be slid the desired distance into portion 50*f* until the bracket engages the top and bottom of the housing of the traffic signal assembly. Then the set screw 50*g* can be tightened to maintain the two L-shaped members fixed to one another.

Instead of using collar terminations 25 as explained in the previous embodiments, the bracket 50 is equipped with terminal elbow-like members 55. Each elbow 55 has a pipe-like section 55*a* which is shown having a plurality of channels 55*f* and which is inserted within the portions 50*c* and 50*d* in a force-fit or other frictional engagement. The elbows are secured to the portions 50*c*, 50*d* by staking. That is to say, each elbow 55 has formed within section 55*a* a circular transverse groove 55*i* (as shown in FIGS. 8 and 9). The ends 50*g* of the shorter straight portions (50*c*, 50*d*) of the L-shaped members are punched downward into the groove 55*i* at say, three to five spaced points. This prevents the removal of the elbow 55 from the portions 50*c*, 50*d*. However, the elbow 55 is thereby permitted to rotate somewhat about the axis of the portion 55*d* for desired adjustments in mounting the traffic light assembly.

The elbow 55 has a curved intermediate section 55*k* between section 55*a* and threaded section 55*e* which has a curved interior passageway 55*c* communicating with the bore of the end portion 55*a* and the bore of the threaded second end portion 55*e*. The central portion 55*k* is structurally reenforced by two vanes 55*b* and 55*h* integrally formed therewith.

The elbow 55 also has an annular flanged portion 55*d* formed integrally with the central section 55*k*. The end section 55*e* is provided with threads 55*i* to which a lock nut may be secured after section 55*e* is passed through a hole in the traffic signal assembly. The flanged portion 55*d*, as may be seen in FIG. 9 is formed with a plurality of serrations 55*g* generally radially disposed about its flat outer surface. These serrations 55*g* are designed to mate with corresponding serrations in the bottom of the traffic signal assembly housing to prevent the latter from rotating about its axis or with respect to the elbow 55. It is also provided with a circular channel 55*m* within which a compressible circular O-ring may be inserted to help insure a weather-proof and dust-proof seal when the elbow is fastened to the traffic signal assembly housing by the internal lock nut screwed onto the threaded portion 55*a*.

Of course, the present invention may take on a variety of other forms which will immediately suggest themselves to one skilled in the art upon perusing the present specification and drawings herein. For example, the portion 55*a* need not be made with channels as shown, but rather could be done in any other way to provide a friction fit of the portion 55*a* within the portion 50*d*. Thus, for example, splines, corrugations or a fluted surface could be formed on the outside surface of 55*a* instead of the serrations as shown. Still other modifications will occur and it is therefore requested that this invention be limited solely by the claims which follow.

I claim:

1. An assembly for mounting traffic signals or the like comprising:

a. a first rigid, generally J-shaped tubular means having a generally curved end portion permanently and rigidly joined to a straight portion, said curved end portion being adapted to engage one end of said signals, b. a second rigid, generally J-shaped tubular means having a generally curved end portion for engaging the other end of said signal joined to a straight portion into which the straight portion of said (a) means is adapted to be slid, and also having adjustable means disposed transverse thereto which protrudes interiorly thereof a selected distance thereby to engage said (a) means, said adjustable means being constructed to fix the relative position of said (a) and (b) means when assembled together so that a fixed desired distance exists between the curved ends thereof, the terminal parts of said curved ends being arranged to be substantially aligned with one another along an axis substantially parallel to the axis of said straight portions said (b) means having a cross-section which is slightly larger than the cross-section of said (a) means.

2. The mounting assembly according to claim 1 where the terminal part of said curved ends is straight and has the form of a truncated cylinder, said truncated end being fixed to a correspondingly angled part of said curved end.

3. The mounting assembly according to claim 2 wherein said terminal part is disposed substantially parallel to said straight portions.

4. The mounting assembly according to claim 2 wherein the free ends of said terminal parts are provided with fittings for engaging said traffic signals.

5. The mounting assembly according to claim 1 wherein said generally curved end portions have a part generally transverse to the axis of said straight portion which is integral with a generally straight part which is parallel to said axis.

6. The mounting assembly according to claim 5 wherein said part parallel to said axis is provided with a fitting for engaging said traffic signal.

7. The mounting assembly according to claim 1 wherein the generally curved end portions comprise a relatively straight part and an elbow-like part joined substantially permanently thereto at one end, said elbow-like part having one straight end, said elbow-like part having a second end constructed to engage the housing of said traffic signal.

8. The mounting assembly according to claim 1 wherein at least one of said (a) or (b) members is provided with a generally transverse aperture to permit the passage of conductors through said aperture for connection to said traffic signal.

9. The mounting assembly according to claim 1 with the addition of means connected to said curved end portions for engaging a traffic signal.

10. The invention according to claim 7 wherein said first straight end of said elbow-like part has a plurality of substantially parallel axial channels formed in the outer surface thereof and wherein said first straight end is dimensioned to provide a friction fit within the bore of the relatively straight part of said generally curved end portion, said relatively straight part having a substantially smooth outer surface and bore.

11. The invention according to claim 10 wherein said first straight end of said elbow includes a groove into which the end of said relatively straight part of said curved end portion is staked.

* * * * *